US006079967A

United States Patent [19]

Fujiwara

[11] Patent Number: 6,079,967

[45] Date of Patent: Jun. 27, 2000

[54] FLUID COMPRESSOR

[75] Inventor: Takayoshi Fujiwara, Hino, Japan

[73] Assignee: Kabushiki Kaisha Toshiba, Japan

[21] Appl. No.: 08/998,415

[22] Filed: Dec. 24, 1997

[30] Foreign Application Priority Data

Oct. 1, 1997 [JP] Japan ..... 9-002984

[51] Int. Cl.[7] ..... F01C 21/08

[52] U.S. Cl. ..... 418/220; 418/94; 418/96; 418/88

[58] Field of Search ..... 418/220, 94, 96, 418/88

[56] References Cited

U.S. PATENT DOCUMENTS 5,174,737 12/1992 Sakata et al. ..... 418/55.1
5,388,969 2/1995 Fujiwara et al. ..... 418/220
5,558,512 9/1996 Fujiwara et al. ..... 418/220

*Primary Examiner*—Thomas Denion
*Assistant Examiner*—Thai-Ba Trieu
*Attorney, Agent, or Firm*—Limbach & Limbach LLP

[57] ABSTRACT

A fluid compressor comprises a sealing case, an oil reservoir formed to an inner bottom portion of the sealing case, in an installed state, for storing an lubricating oil and a compression mechanism having a helical blade structure housed in the sealing case. The compression mechanism comprises a cylinder, a rotating member arranged in the cylinder so as to perform eccentric motion and a helical blade interposed between the rotating member and the cylinder for defining a plurality of partitioned compression chambers. The fluid compressor further comprises an electric motor unit housed inside the sealing casing in operative connection to the compression mechanism. The compression mechanism has a vertical structure in which the fluid is compressed and transferred in a perpendicular direction in the installed state. The compression mechanism is provided with a sucking portion for the fluid to be compressed to a portion below the rotating member, the rotating member is provided with an end surface located on the side of the sucking portion for defining a thrust surface which is supported by a bearing, and the thrust surface of the rotating member is immersed in the lubricating oil supplied from the oil reservoir.

6 Claims, 2 Drawing Sheets

FLUID COMPRESSOR

BACKGROUND OF THE INVENTION

The present invention relates to a fluid compressor which is used in refrigeration cycle apparatus, for example, and which includes a compression mechanism unit of helical blade type and compresses a coolant gas as a gas to be compressed.

Recently, there have been proposed fluid compressors called also helical blade type compressors. In such a fluid compressor, a cylinder is arranged in a sealing case and a roller as a rotating member is eccentrically arranged in the cylinder to revolve around an axis of the cylinder.

A blade is fitted between a circumferential surface of the roller and an inner circumferential surface of the cylinder to define a plurality of compression chambers. A coolant gas for use in the refrigeration cycle, i.e., a fluid to be compressed, is sucked into one of the compression chambers at one end and transferred to another compression chamber at the other end successively while being gradually compressed.

With the above-mentioned type compressor, it is possible to eliminate a problem, e.g., a failure in sealing, that is encountered in conventional compressors of reciprocal and rotary types, to improve a sealing performance for more efficient compression with a relatively simple construction and to facilitate manufacture and assembly of of parts of the compressor.

Meanwhile, there are two types of compression mechanism units, one being a horizontal type in which the direction of compressing and transferring the gas is set to be horizontal and the other being a vertical type in which the direction of compressing and transferring the gas is set to be vertical.

For a compression mechanism unit of such horizontal type, a roller is arranged with its axis lying in the horizontal direction, and a thrust surface of the roller, i.e., a contact surface between the roller and a bearing, lies in the vertical direction.

An oil reservoir for storing lubricating oil is formed in an inner bottom portion of a sealing case, and the thrust surface of the roller is partly immersed in the lubricating oil within the oil reservoir. Accordingly, wherever a sucking portion for the compressed gas is positioned, no problems occur in supply of the oil to the thrust surface of the roller.

On the contrary, for a compression mechanism unit of the vertical type in which the direction of transferring the compressed gas is set to be vertical, a problem occurs in efficiency of oil supply to the thrust surface of the roller on the sucking side depending upon the position where the gas sucking portion is located.

If the gas sucking position is located in an upper portion of the roller, the lubricating oil supplied to the thrust surface at the top of the roller flows down instantly for the structural reason. This results in a difficulty in sufficiently supplying the lubricating oil to the thrust surface at all times and increases wear of the thrust surface.

During stoppage of the operation, the roller is axially moved down because of its dead load. Thus, a small gap is left between the top of the roller and the thrust surface on the upper side, i.e., on the sucking side, and a positive sealing surface cannot be realized.

At the start-up of the operation, therefore, the sucked gas leaks through the gap at the sealing surface and the compression efficiency is hence lowered.

Further, since the gas is delivered from a lower portion of the compression mechanism which is immersed in the lubricating oil within the oil reservoir, the gas is delivered into the lubricating oil, and a problem occurs if the oil reservoir of the lubricating oil is located on the gas delivering side.

For the above reason, the compression mechanism with the gas delivering side located in an upper portion has been proposed. Japanese Patent Laid-Open Publication No. HEI 4-58086 previously filed by the applicant discloses, as one example of such compression mechanisms, a fluid compressor with the gas delivering side located in an upper portion and the gas sucking side located in an upper portion.

In the above-cited Publication, however, a structure for supplying oil to the thrust surface is not described specifically.

SUMMARY OF THE INVENTION

An object of the present invention is to substantially eliminate defects or drawbacks encountered in the prior art described above and to provide a fluid compressor including a vertical compression mechanism unit of helical blade type, capable of sufficiently supplying oil to a thrust surface of a rotating member to prevent wear of the thrust surface and preventing an axial movement of the rotating member after the operation has been stopped, thereby ensuring excellent sealing performance at the thrust surface and improving the compression efficiency.

This and other objects can be achieved according to the present invention by providing a fluid compressor comprising:

a sealing case;

an oil reservoir formed to an inner bottom portion of the sealing case, in an installed state, for storing an lubricating oil;

a compression mechanism unit having a helical blade structure housed in the sealing case, the compression mechanism unit comprising a cylinder, a rotating member arranged in the cylinder so as to perform eccentric motion and a helical blade interposed between the rotating member and the cylinder for defining a plurality of partitioned compression chambers, the compression mechanism unit serving to suck a fluid to be compressed into one of the compression chambers positioned at one end thereof and to transfer the fluid toward another compression chamber at another one end thereof while compressing the fluid; and an electric motor unit housed inside the sealing casing in operative connection to the compression mechanism unit, wherein the compression mechanism unit has a vertical structure in which the fluid is compressed and transferred in a perpendicular direction in the installed state, the compression mechanism unit is provided with a sucking portion for the fluid to be compressed to a portion below the rotating member, the rotating member is provided with an end surface located on the side of the sucking portion for defining a thrust surface which is supported by a bearing, and the thrust surface of the rotating member is immersed in the lubricating oil supplied from the oil reservoir.

In preferred embodiments, the compression mechanism unit is disposed below the electric motor unit in level in an installed state of the sealing case and the bearing is formed with an oil guide hole through which the lubricating oil in the oil reservoir is guided to the thrust surface of the rotating member.

An oil supply mechanism for supplying an oil to the compression mechanism unit may be further disposed, the oil supply mechanism being arranged so as to be immersed in the lubricating oil in the oil reservoir.

The electric motor unit may be disposed below the compression mechanism unit in level in an installed state and has a rotational shaft projecting from an upper end surface of the electric motor unit and coupled to the compression mechanism unit. The compression mechanism unit has a portion in which the lubricating oil is stored by the bearing and the thrust surface of the rotating member is immersed in the lubricating oil.

An Oldham's mechanism engaged with the rotating member may be disposed for preventing a self-rotation of the cylinder about an axis thereof and the Oldham's mechanism is arranged at the end of the rotating member on the side of the fluid sucking portion.

The rotating member has a cylindrical structure and is formed with a helical groove along a circumferential surface thereof, the helical blade is wound along and fitted to the helical groove so as to be come out of and into the helical groove, thereby partitioning a space between the rotating member and the cylinder into a plurality of working chambers, and the rotating member is caused to revolve around an axis of the cylinder.

The sucking portion is constituted by a suction pipe connected to a side surface of the cylinder.

According to the present invention of the characters mentioned above, the oil supply to the thrust surface of the rotating member constituting the compression mechanism unit can be ensured and the thrust surface is not worn away. The rotating member is not moved in the axial direction after the operation has been stopped, and the thrust surface located on the sucking side is held continuously in a sealed state. Accordingly, no sucked gas leaks upon starting up the operation again. In addition, the oil delivery side can be made open directly to an inner space of the enclosed case, thus being advantageous.

The nature and further characteristic features of the present invention may be made further clear from the following descriptions made with reference to the accompanying drawings.

DESCRIPTION OF THE PREFERRED EMBODIMENTS

One embodiment of the present invention will be described hereunder with reference to FIG. 1 of the accompanying drawings, in which a helical blade type compressor is employed in, for example, a refrigeration cycle of an air conditioner. Thus, a fluid to be compressed is a coolant gas.

Figure 1:
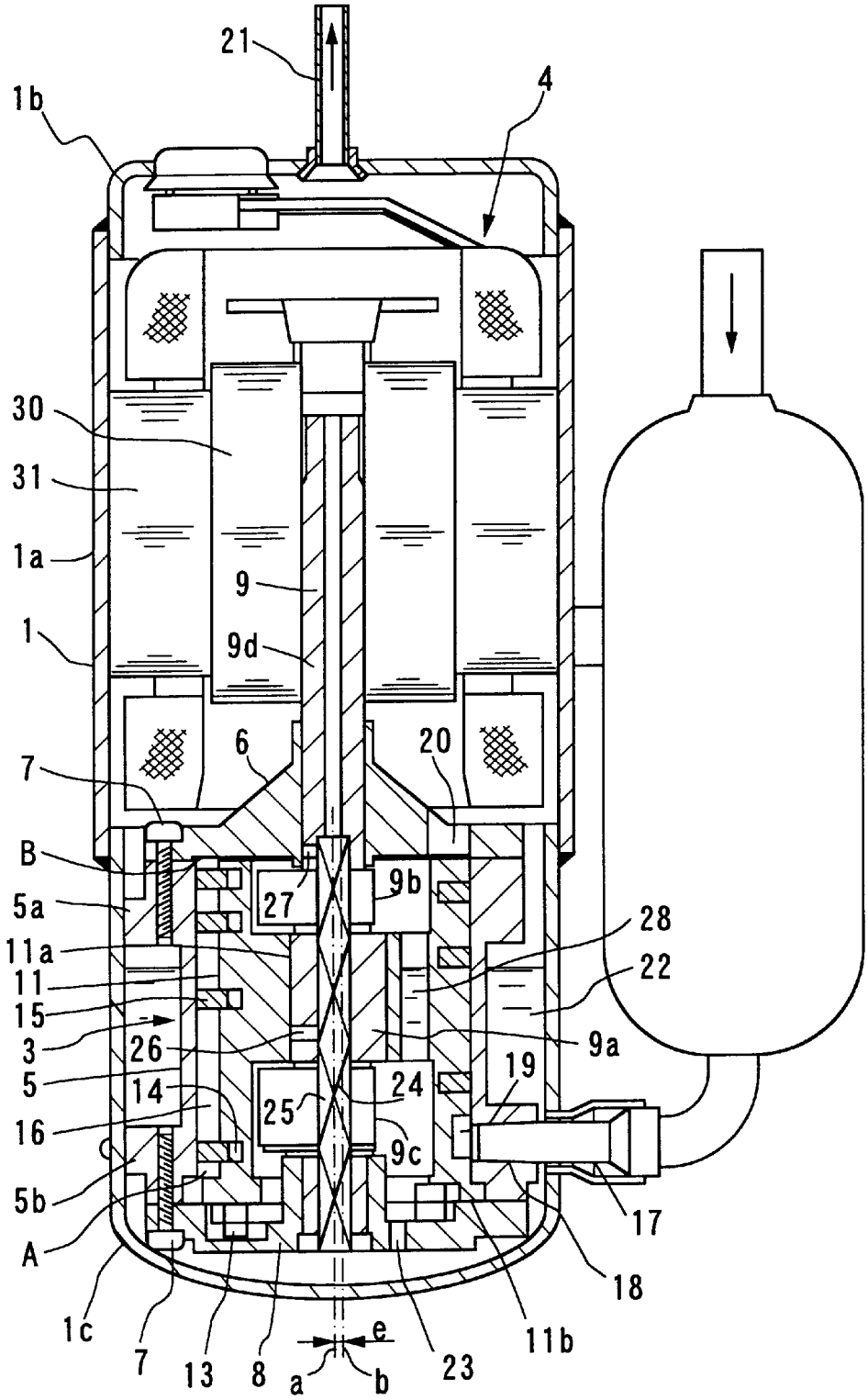
FIG. 1 is a vertical sectional view of a helical blade type compressor representing one embodiment of the present invention.

As shown in FIG. 1, a sealing case 1 is composed of a case body 1*a* having its axis lying in the vertical direction and being opened at both ends thereof, an upper cover 1*b* for closing an upper open end of the case body 1*a*, and a lower cover 1*c* for closing a lower open end of the case body 1*a*.

Within the sealing case 1, there are installed a compression mechanism unit 3 of helical blade type and an electric motor unit 4. Specifically, on both sides of substantially the middle of the sealing case 1 in the axial direction, the compression mechanism unit 3 is located in a lower portion and the electric motor unit 4 is located in an upper portion, as viewed in FIG. 1.

The compression mechanism unit 3 includes a cylinder 5 being in the form of a hollow tube made open at both ends and having a pair of flanges 5*a* and 5*b* projected on its outer circumferential surface near both the ends. At least one 5*a* of the flanges of the cylinder 5 is press-fitted into the case body 1*a* of the enclosed case 1 so that the cylinder 5 is positioned and fixed in place.

A main bearing 6 is attached and fixed to an upper end surface of the cylinder 5 by a fixing member 7 to close the upper open end of the cylinder. A sub-bearing 8 is attached and fixed to a lower end surface of the cylinder 5 by a fixing member 7 to close the lower open end of the cylinder.

A crankshaft 9, i.e., a rotating shaft, is inserted through the main bearing 6 and the sub-bearing 8 along their axes and is supported rotatably. The crankshaft 9 extends so as to penetrate an inner space of the cylinder 5 between the main bearing 6 and the sub-bearing 8 and to project upward from the main bearing 6, as viewed on the drawing, thus constituting a rotary shaft portion 9*d* of the electric motor unit 4.

A crank portion 9*a* having an eccentric axis b offset by a predetermined distance e from an axis a of the crankshaft 9 is integrally provided on the crankshaft 9 between the main bearing 6 and the sub-bearing 8.

Further, a first counterbalancer 9*b* and a second counterbalancer 9*c* are integrally provided on the crankshaft 9 in positions respectively adjacent to upper and lower ends of the crank portion 9*a*. Each of those counterbalancers 9*b* and 9*c* is eccentrically projected from an outer circumferential surface of the crankshaft 9 in diametrically opposite relation to the eccentrically projecting direction of the crank portion 9*a* with respect to the shaft axis.

Between the crankshaft 9 and the cylinder 5, there is interposed a roller 11, i.e., a rotating member, made of a material having specific gravity smaller than that of iron, e.g., an aluminum alloy material. The roller 11 is in the form of a cylindrical body made open at both ends and having the same axial length as that of the cylinder 5.

An inner circumferential portion of the roller 11 which is positioned to face the crank portion 9*a* of the crank shaft 9 has the same width as that of the crank portion and forms a portion defining a roller cavity and support the rotation thereof (called as cavity-defining/support portion hereinafter) 11*a* coming into slide contact with an outer circumferential surface of the crank portion 9*a* in a rotatable manner.

According to the above structure, the roller 11 has an axis b aligned with the axis b of the crank portion 9*a* and offset by the distance e from the axis a of the cylinder 5, etc. Then, parts of an outer circumferential wall of the roller 11 are so sized as to contact corresponding parts of an inner circumferential wall of the cylinder 5 while being rolled in the axial direction.

The roller 11 is supported at its lower end by the sub-bearing 8, and therefore, a lower end surface of the roller 11 serves as a thrust surface. Between the lower end of the roller and the sub-bearing 8, there is interposed an Oldham's mechanism 13 for restricting the rotation of the roller 11 about its own axis.

When the crankshaft 9 is rotated, the crank portion 9*a* is rotated eccentrically, causing the roller 11 supported by the outer circumferential surface of the crank portion to revolve around the shaft axis, i.e., perform an eccentric revolving motion. With the eccentric revolving motion of the roller 11, the position, where the outer circumferential wall of the roller 11 contacts the inner circumferential wall of the cylinder 5 while rolling therealong, is moved progressively in the circumferential direction of the cylinder.

In the outer circumferential wall of the roller 11, a helical groove 14 is so formed as to have a pitch that is gradually reduced from the end to which the sub-bearing 8 is attached toward the end to which the main bearing 6 is attached. A helical blade 15 is wound along and fitted to the helical groove 14 in a manner capable of coming out of and into the helical groove.

The blade 15 is made of a material giving a highly sliding surface, such as a fluorine resin, for example, and is formed to have an inner diameter larger than the outer diameter of the roller 11. In other words, the blade 15 is fitted to the helical groove 14 in such a state that its diameter is forcibly contracted. As a result, when the blade 15 is assembled in the cylinder 5 together with the roller 11, the blade is deformed to bulge out of the helical groove 14 so that its outer circumferential surface is always resiliently urged into contact with the inner circumferential surface of the cylinder.

When the roller 11 revolves around the shaft axis and its rolling contact position with respect to the cylinder 5 is moved, as described above, part of the blade 15 is more retracted into the helical groove 14 upon approaching of the rolling contact position. In the rolling contact position, the outer circumferential surface of the blade is completely flush with the outer circumferential surface of the roller.

On the contrary, after passage of the rolling contact position, the part of the blade 15 projects out of the helical groove 14 corresponding to the distance therefrom to the rolling contact position. At a position opposing by 180° to the rolling contact position about the axis b, the length by which the blade 15 projects out of the helical groove 14 is maximized. After that, the rolling contact position again approaches the part of the blade 15, and therefore, the above-mentioned contracting movement is repeated.

On the other hand, as viewed from a section crossing the cylinder 5 and the roller 11 in the radial direction, the roller 11 is eccentrically housed in the cylinder 5 and part of the circumferential surface of the roller is held in rolling contact with the cylinder. A crescent-shaped vacant space is thus formed between the cylinder and the roller.

When the vacant space is observed in the axial direction, since the helical blade 15 is wound along and fitted to the helical groove 14 and a part of the circumferential surface of the roller is held in rolling contact with the inner circumferential wall of the cylinder 5, the vacant space between the roller and the cylinder is partitioned by the blade into a plurality of spaces.

The partitioned spaces are called compression chambers 16. In accordance with the setting of the helical groove 14, the volume of each compression chamber 16 is gradually reduced from the end, to which the sub-bearing 8 is attached, toward the end to which the main bearing 6 is attached, and also, from the viewpoint of the pitch setting of the helical groove 14, the compression chamber 16 at the bottom serves as a sucking portion A and the compression chamber 16 at the top serves as a delivering portion B.

Meanwhile, a suction pipe 17 communicating with an evaporator, not shown, which constitutes the refrigeration cycle, is provided so as to penetrate a side wall of the lower cover 1*c* constituting the sealing case 1. Within the sealing case 1, the suction pipe 17 is connected to a connecting portion 18 provided on a circumferential surface of the lower flange 5*b* of the cylinder 5.

The connecting portion 18 is in the form of an opening defined to penetrate the cylinder 5 to reach the inner circumferential surface thereof and to be open toward the outer circumferential surface of the roller 11. That is, the connecting portion 18 serves as a gas sucking portion for sucking and guiding the coolant gas into the compression chamber 16 formed between the roller 11 and the cylinder 5, and in this meaning, the connecting portion will be referred to as a gas sucking portion hereinafter.

The gas sucking portion 18 is provided at the lower end of the cylinder 5 and hence communicated with the compression chamber 16 at one end. Further, since the lower end of the roller 11 provides a thrust surface 11*b* supported by the sub-bearing 8, it can also be said that the gas sucking portion 18 is provided on the side of the thrust surface 11*b* of the roller 11.

A recessed portion 19 is formed in the outer circumferential surface of the roller 11 at a position facing the gas sucking portion 18, enabling the gas introduced through the suction pipe 17 to be once accumulated in the recessed portion 19.

The main bearing 6 has a delivery port 20 formed to extend in parallel to the axial direction so that the high-pressure gas compressed through the compression chambers 16 is delivered and guided into the enclosed case 1. A delivery pipe 21 is connected to the upper cover 1*b* constituting the sealing case 1 and communicated with a condenser, not shown, which constitutes the refrigeration cycle.

In addition, an oil reservoir 22 for storing lubricating oil is formed in an inner bottom portion of the sealing case 1. A level of the lubricating oil stored in the oil reservoir 22 is set to be slightly lower than a level of the upper flange 5*a* of the cylinder 5 so that large part of the cylinder 5, the gas sucking portion 18 and the sub-bearing 8 are immersed in the lubricating oil.

An oil introducing hole 23 is formed in the sub-bearing 8 to penetrate therethrough to reach its upper and lower end surfaces for introducing the lubricating oil to the inside of the sub-bearing 8, i.e., an engaging surface of the Oldham's mechanism 13 and the thrust surface 11*b* of the roller 11. Thus, those surfaces are also immersed in the lubricating oil.

An oil supply pump 24 as an oil supply mechanism is provided in the crankshaft 9 to axially extend from a lower end surface of the crankshaft. The oil supply pump is constructed by inserting pieces of belt-like plates in a twisted state into an oil hole 25 formed through the crankshaft 9.

An oil guide hole 26 is formed in the crank portion 9*a* to be communicated with an intermediate portion of the oil hole 25 for guiding the lubricating oil to the circumferential surface of the crank portion 9*a* and a sliding surface of the cavity-defining/support portion 11*a* of the roller 11. Further, an oil guide hole 27 is formed through a wall of the crankshaft 9 to be communicated with the intermediate portion of the oil hole 25 in a position above the first counterbalancer 9*b* for guiding the lubricating oil to sliding surfaces of both the crankshaft 9 and the main bearing 6.

The oil hole 25 is formed such that its diameter is reduced just above the upper oil guide hole 27 and its upper end is opened to an upper end surface of the crankshaft 9.

The cavity-defining/support portion 11*a* of the roller 11 has an oil escape hole 28 formed to extend parallel to the axial direction for guiding the lubricating oil to the side of the first counterbalancer 9*b*.

Meanwhile, the electric motor unit 4 comprises a rotor 30 fitted over the rotary shaft portion 9*d* of the crankshaft 9 projecting out of the main bearing 6 and a stator 31 fitted to an inner circumferential surface of the case body 1*a* while leaving a predetermined gap with respect to an outer circumferential surface of the rotor.

A fluid compressor of helical blade type is thus constructed, and an electric current is supplied to the electric motor unit 4 for rotating the crankshaft 9 together with the rotor 30. The rotating force of the crankshaft 9 is transmitted to the roller 11 through the crank shaft 9*a*.

Since the crank portion 9*a* is eccentric and the cavity-defining/support portion 11*a* of the roller 11 is rotatably fitted over the crank portion 9*a*, the roller is pushed by the crank portion. In addition, since the Oldham's mechanism 13 interposed between the roller 11 and the sub-bearing 8 restricts the rotation of the roller about its own axis, the roller revolves around the shaft axis.

On the other hand, the coolant gas under a low pressure is sucked through the suction pipe 17 and temporarily accumulated in the recessed portion 19 formed in the roller 11 just before being introduced to the compression chamber 16 from the gas sucking portion 18. The coolant gas is then introduced to the compression chamber 16 on the side of the sucking portion A.

As the roller 11 revolves around the shaft axis, the rolling contact position of the roller with respect to the inner circumferential wall of the cylinder 5 is moved progressively in the circumferential direction of the cylinder, causing the blade 15 to come out of and into the helical groove 14. Thus, the blade 15 is moved to project and retract in the radial direction of the roller.

Because the blade 15 has the helical form, the coolant gas introduced to the compression chamber 16 on the side of the sucking portion A is transferred toward the compression chamber 16 on the side of the delivering portion B successively with the revolution of the roller 11 around the shaft axis.

Since the blade 15 has a pitch set to gradually reduce from the side of the sucking portion A to the side of the delivering portion B and the volume of each of the compression chambers 16 partitioned by the blade are also gradually reduced, the coolant gas is compressed while being transferred through the compression chambers successively and is then pressurized to predetermined high pressure in the compression chamber 16 nearest to the delivering portion B.

The gas under high pressure is delivered from the compression chamber 16 defining the delivering portion B and introduced to an upper space of the sealing case 1 on the side of the electric motor unit 4 through the delivery port 20 formed in the main bearing 6. Then, the high-pressure gas is guided to the condenser through the delivery pipe 21 attached to the upper end of the sealing case 1.

It is to be noted that because the delivering portion B is formed at the upper end of the roller 11 and the sucking portion A is formed at the lower end thereof, there occurs a thrust force from the delivering portion B toward the sucking portion A, causing the end surface (lower end surface) of the roller on the side of the sucking portion A to easily come into slide contact with the sub-bearing 8.

However, according to the present invention, since the roller 11 revolves around the shaft axis, the circumferential speed of the roller is made small and such a sliding loss as affecting the compression efficiency is not generated.

In addition, since the thrust surface 11*b* defined by the lower end surface of the roller 11 is immersed in the lubricating oil introduced through the oil guide hole 23 formed in the sub-bearing 8, no sliding resistance is produced and smooth motion of the roller 11 is ensured.

Since the Oldham's mechanism 13 is also immersed in the lubricating oil, the Oldham's mechanism 13 operates smoothly to surely restrict the rotation of the roller 11 about its own axis.

Even when the supply of electric current to the electric motor unit 4 is cut off to stop the operation of the compression mechanism unit 3, the roller 11 is not further moved down from the operating position in the axial direction. Furthermore, with the thrust surface 11*b*, i.e., the lower end surface of the roller 11, immersed in the lubricating oil, the thrust surface is held in a sealed state.

Upon starting up the operation again, therefore, the sucked gas will never leak through the thrust surface 11*b*, resulting in the achievement of sufficient sealing performance and compression efficiency.

Since the suction pipe 17 is connected to a side surface of the cylinder 5, the gas sucking portion 18 is located in the side surface of the cylinder 5. This makes it possible to reduce a flow path resistance increased at a time when the gas is sucked and also possible to increase the volume efficiency with ease.

Figure 2:
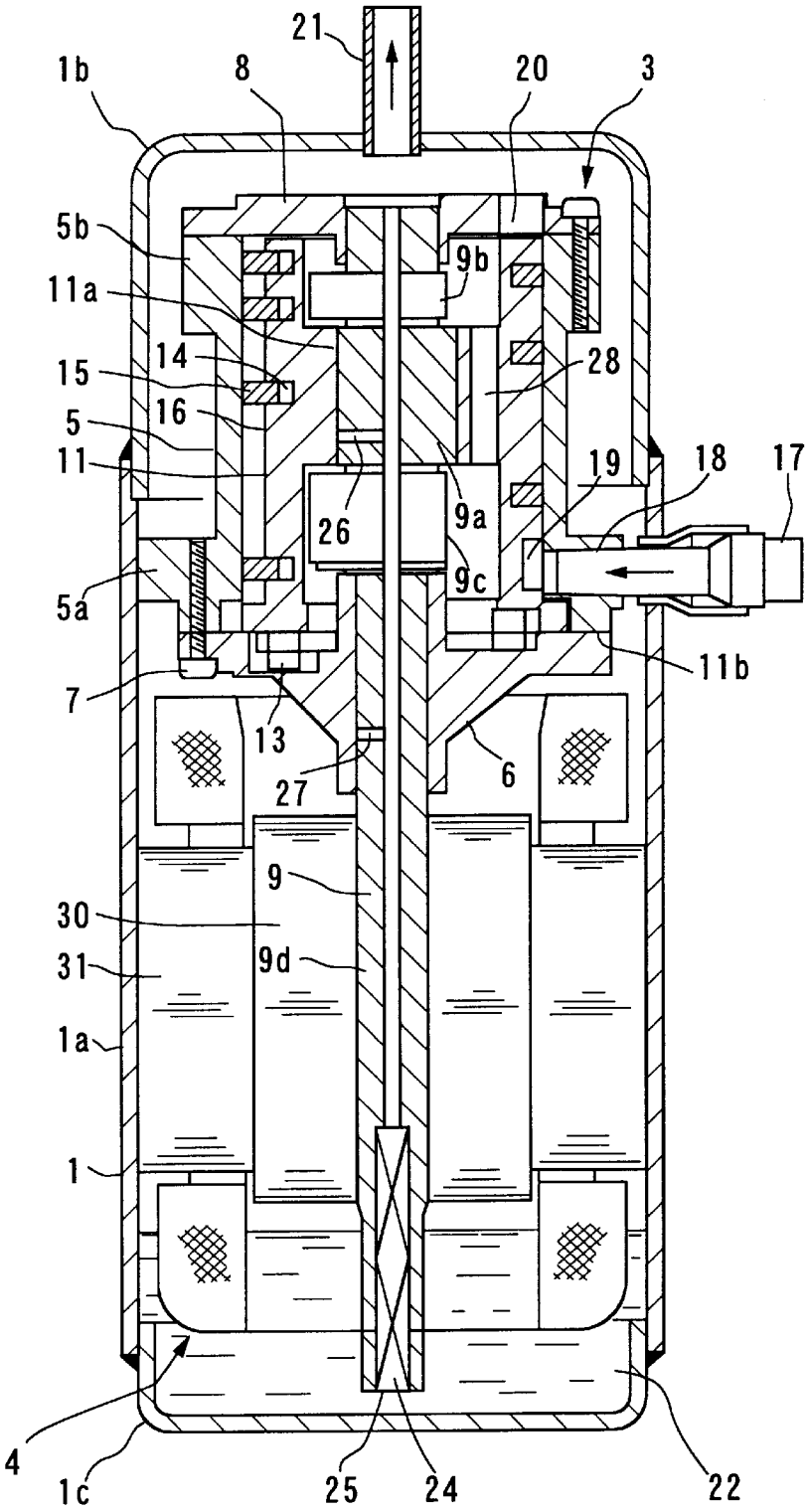
FIG. 2 is a vertical sectional view of a helical blade type compressor representing another embodiment of the present invention.

FIG. 2 shows another embodiment of the present invention, in which an electric motor unit 4 is arranged on the lower side of the compression mechanism unit 3, which is of helical blade type, arranged on the upper side within a sealing case 1 having an vertically elongate shape. The electric motor unit 4 and the compression mechanism unit 3 are structured similarly as described above in connection with FIG. 1 except the points described below. Hence the same components will be denoted by the same reference numerals and a description will not be repeated on the same structures.

Specifically, in the compression mechanism unit 3, a main bearing 6 is located on the lower side and a sub-bearing 8 is located on the upper side. Thus, the main bearing 6 and the sub-bearing 8 are reversed in position and posture. Accordingly, a lower end of a roller 11, i.e., a rotating member, is supported by the main bearing 6 and a gas delivery port 20 is formed through the sub-bearing 8.

A gas sucking portion 18 is provided on the side of a thrust surface 11*b* of the roller 11 similarly to the above embodiment. Although the thrust surface 11*b* is spaced from an oil reservoir 22 which is formed in an inner bottom portion of the sealing case 1 for storing lubricating oil, the thrust surface 11*b* and the oil reservoir 22 are communicated with each other through an oil hole 25 and an oil supply pump 24 provided in a lower end portion of a crankshaft 9. Accordingly, there occurs no problem in supply of the lubricating oil to the thrust surface 11*b*.

Further, the lubricating oil having lubricated a circumferential surface of a crank portion 9*a* and a sliding surface of a cavity-defining/support portion 11*a* of the roller 11 flows down and reaches an upper surface of the main bearing 6 by which the lower end of the roller 11 is supported.

The upper surface of the main bearing 6 is surrounded by an inner circumferential surface of a cylinder 5, and the main bearing 6 is fixed to a lower flange 5*b* of the cylinder. The lubricating oil having fallen down from the above is therefore accumulated on the upper surface of the main bearing 6 so that the thrust surface 11*b* is immersed in the lubricating oil. Likewise, an Oldham's mechanism 13 is also immersed in the lubricating oil.

Moreover, even when the supply of electric current to the electric motor unit 4 is cut off to stop the operation of the compression mechanism unit 3, the roller 11 is not further moved down from the operating position in the axial direction. In addition, since the lubricating oil is sufficiently supplied to the thrust surface 11*b* of the roller 11, the thrust surface is held continuously in a sealed state. Accordingly, sealing performance is not impaired and therefore the compression efficiency is kept high.

According to the invention of the structures and characters mentioned above, an oil can be sufficiently supplied to a thrust surface of a rotating member and wear of the thrust surface can be prevented. Furthermore, after the operation is stopped, the rotating member does not move in the axial direction and the thrust surface can be held continuously in a sealed state. As a result, no sucked gas leaks upon starting up the operation again and the compression efficiency is improved.

It is to be noted that the present invention is not limited to the described embodiment and many other changes and modifications may be made without departing from the scopes of the appended claims.

What is claimed is:

1. A fluid compressor comprising:

a sealing case having an inner bottom portion;

an oil reservoir formed to said inner bottom portion for storing a lubricating oil, in a vertically installed state of the fluid compressor;

an electric motor unit housed on one end side in the sealing case; and a compression mechanism unit housed on another end side in the sealing case and having a helical blade structure housed in said sealing case, said compression mechanism unit comprising a cylinder, an upper bearing mounted to an upper end surface of the cylinder, a lower bearing mounted to a lower end surface of the cylinder, a rotational shaft penetrating said cylinder and supported by said upper and lower bearings to be rotatable, a rotating member arranged in said cylinder and carrying out an eccentric motion by the rotation of said rotational shaft, and a helical blade interposed between said rotating member and said cylinder for defining a plurality of partitioned compression chambers, said compression mechanism unit serving to suck a fluid to be compressed into one of the compression chambers positioned at one end thereof and to transfer the fluid towards another compression chamber at another one end thereof while compressing the fluid, wherein said compression mechanism unit has a vertical structure in which the fluid is compressed and transferred in a perpendicular direction, said compression mechanism unit is provided with a sucking portion for the fluid to be compressed to a portion below said rotating member, said rotating member is provided, on a circumferential surface, with a helical groove to which said helical blade is wound about the groove thereby partitioning a space between said rotating member and said cylinder into a plurality of working chambers, said rotating member performs a revolving motion with respect to the cylinder and is provided with an end surface located on the side of said sucking portion for defining a thrust surface which is supported by the lower bearing, and an Oldham's mechanism is engaged with the rotating member for preventing a self-rotation of said cylinder about an axis thereof said Oldham's mechanism being arranged at the end of said rotating member on the side of the fluid sucking portion, said thrust surface of the rotating member and said Oldham's mechanism being immersed in the lubricating oil supplied from said oil reservoir.

2. A fluid compressor according to claim 1, wherein said compression mechanism unit is disposed below said sealing case and said lower bearing is formed with an oil guide hole through which the lubricating oil in the oil reservoir is guided to the thrust surface of the rotating member.

3. A fluid compressor according to claim 2, further comprising an oil supply mechanism for supplying an oil to said compression mechanism unit, said oil supply mechanism being arranged so as to be immersed in the lubricating oil in said oil reservoir.

4. A fluid compressor according to claim 1, wherein said electric motor unit is disposed below said sealing case and has a rotational shaft projecting from an upper end surface of said electric motor unit and coupled to said compression mechanism unit.

5. A fluid compressor according to claim 4, wherein said compression mechanism unit has a portion in which the lubricating oil is stored by said lower bearing and said thrust surface of the rotating member is immersed in the lubricating oil.

6. A fluid compressor according to claim 1, wherein said sucking portion is constituted by a suction pipe connected to a side surface of said cylinder.

* * * * *

UNITED STATES PATENT AND TRADEMARK OFFICE

CERTIFICATE OF CORRECTION

PATENT NO.: 6,079,967
DATED: June 27, 2000
INVENTOR(S): Takayoshi Fujiwara

It is certified that an error appears in the above-identified patent and that said Letters Patent is hereby corrected as shown below:

On the Title Page of the Patent, under "Foreign Application Priority Data", the date of the foreign priority application is incorrect. Please change "October 1, 1997" to read -- January 10, 1997 --.

Signed and Sealed this

Third Day of April, 2001

*Attest:*

Nicholas P. Godici

NICHOLAS P. GODICI

*Attesting Officer*

*Acting Director of the United States Patent and Trademark Office*